United States Patent [19]

Reynolds, III

[11] 3,990,384

[45] Nov. 9, 1976

[54] HULL WITH RIGHTING MOMENT PRODUCING FINS

[76] Inventor: Collins J. Reynolds, III, 1615 Krameria St., Denver, Colo. 80220

[22] Filed: Aug. 8, 1975

[21] Appl. No.: 603,247

[52] U.S. Cl. ..... 114/126; 114/39; 114/149

[51] Int. Cl.[2] ..... B63B 39/06

[58] Field of Search ..... 114/126, 140, 143, 149, 114/39, 128, 162, 167, 66.5 H; 244/42 DA, 87

[56] References Cited

UNITED STATES PATENTS

| | | | |
|---|---|---|---|
| 1,574,567 | 2/1926 | Flettner | 244/42 DA |
| 2,804,038 | 8/1957 | Barkla | 114/66.5 H |
| 2,858,788 | 11/1958 | Lyman | 114/126 X |
| 3,008,442 | 11/1961 | Russell | 114/39 |

*Primary Examiner*—Trygve M. Blix
*Assistant Examiner*—Gregory W. O'Connor
*Attorney, Agent, or Firm*—Clarence A. O'Brien; Harvey B. Jacobson

[57] ABSTRACT

A boat hull including a center depending keel fin is provided and the keel fin includes an upstanding rear edge portion having a horizontally rearwardly opening transverse recess formed therein. An upstanding main fin extending generally longitudinally of the hull is oscillatably supported in the forward portion of the keel fin recess for angular displacement about an upstanding axis spaced forward of the horizontal longitudinal center of the main fin and an upstanding front-to-rear extending servo fin is oscillatably supported from the rear portion of the main fin for angular displacement relative thereto about an upstanding axis. The interior of the hull includes heel sensing drive structure operatively connected between the hull and the servo fin for displacing the latter to starboard relative to the main fin in response to starboard heeling of the hull and displacing the servo fin to port relative to the main fin in response to heeling of the hull to port. The servo fin is relatively small in effective area as compared to the area of the main fin and its displacement to port and starboard serves to oppositely displace the freely swingable main fin to starboard and port, respectively. Displacement of the main fin to port during starboard heeling of the hull during forward movement of the hull through water serves to exert a righting moment on the hull and displacement of the main fin to starboard during port heeling of the hull serves to exert a righting moment on the hull.

7 Claims, 12 Drawing Figures

HULL WITH RIGHTING MOMENT PRODUCING FINS

BACKGROUND OF THE INVENTION

Various forms of stabilizers have been heretofore designed for use on sail and power boats in order to reduce heeling. The limitations of current mono-hull design and ballast stability are poor hull fineness ratios and dead weight inefficiencies, both of which increase drag, reduce speed and require excess power, whether engine or sail, to propel the hull through or over a body of water.

Although other types of hulls such as pure hydrofoils, outriggers and multihulls initially afford considerable resistance to heeling, these hulls are fragile, unstable in rough water and possess neutral or negative righting moments at extreme angles of heel. Accordingly, the mono-hull ship design has enjoyed continued favor, even in the presence of continuous improvements being made in hydrofoils, outriggers and multihulls.

However, while gyroscopically controlled and hydraulically actuated stabilizing foils used on mono-hull design ships appear to be most promising in principle, such systems are complex, heavy, expensive and require two different sources of internally generated power in order to function.

In addition to gyroscopically controlled, stabilizing foils, various other types of righting moment generating devices have been designed for use in conjunction with mono-hulls. Examples of some of these other types of righting moment producing devices are disclosed in U.S. Pat. Nos. 148,454, 537,667, 648,911, 699,231, 3,080,845 and 3,324,815. These previously patented righting moment producing structures are all to some degree operable in the desired manner, but most are constructed in a manner which appreciably increases the drag of the associated hull. Accordingly, these previously patented forms of hull righting moment producing structures have not enjoyed more than limited application.

BRIEF DESCRIPTION OF THE INVENTION

The righting moment producing fin structure of the instant invention is constructed in a manner whereby considerable righting moment may be produced without seriously increasing the water drag on the associated hull. The main object of this invention is to provide righting moment producing fin structure for utilization on sailboats as well as motorboats and which will be operative to produce a righting moment in response to heeling of the associated hull.

Another object of this invention is to provide a righting moment producing fin structure which will not require an external power source.

Still another object of this invention is to provide an apparatus in accordance with the preceding objects and which will be operative to produce a righting moment without also generating excessive increased drag in response to movement of the associated hull through a body of water.

Another very important object of this invention is to provide a righting moment producing fin structure which may be readily incorporated into the construction of sailboat and motorboat hulls.

A final object of this invention to be specifically enumerated herein is to provide an apparatus in accordance with the preceding objects and which will conform to conventional forms of manufacture, be of simple construction and automatic in operation so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
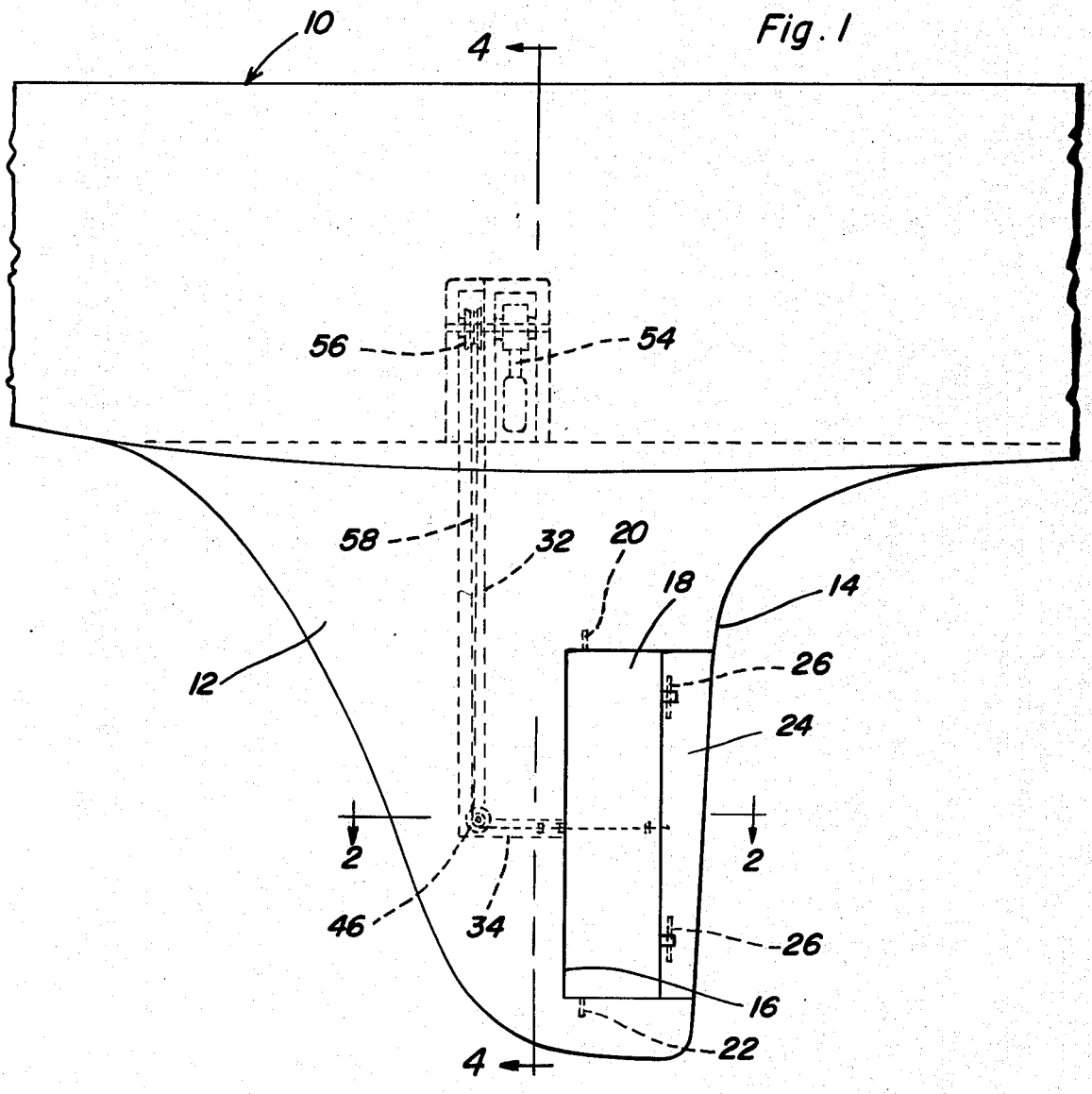
FIG. 1 is a fragmentary side elevational view of a sailboat hull including a depending keel fin with which the righting moment producing fin structure of the instant invention is operatively associated.
Figure 2:
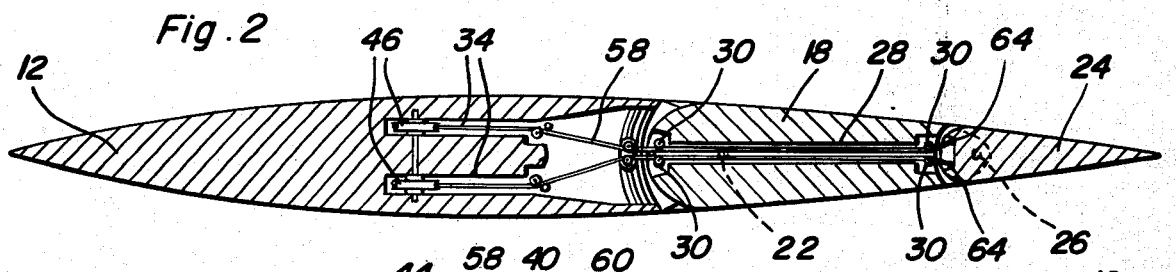
FIG. 2 is an enlarged horizontal sectional view taken substantially upon the plane indicated by the section line 2—2 of FIG. 1.
Figure 3:
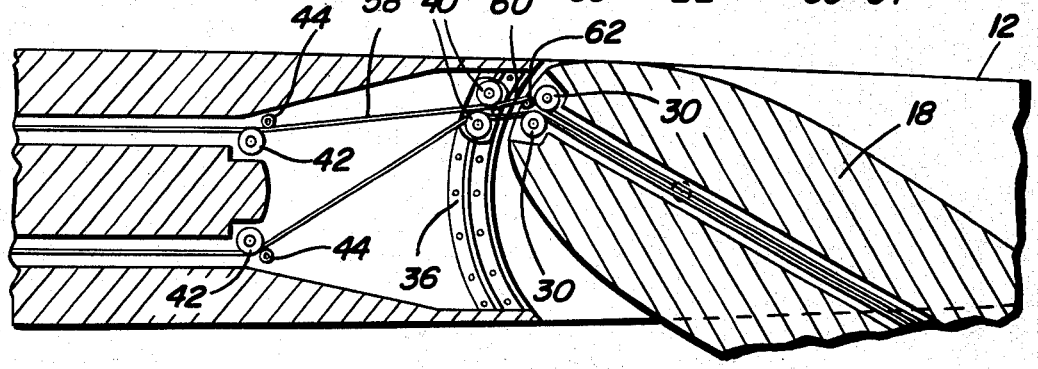
FIG. 3 is a fragmentary enlarged horizontal sectional view of the central portion of FIG. 2 and with the center or main fin in a position displaced to port.
Figure 4:
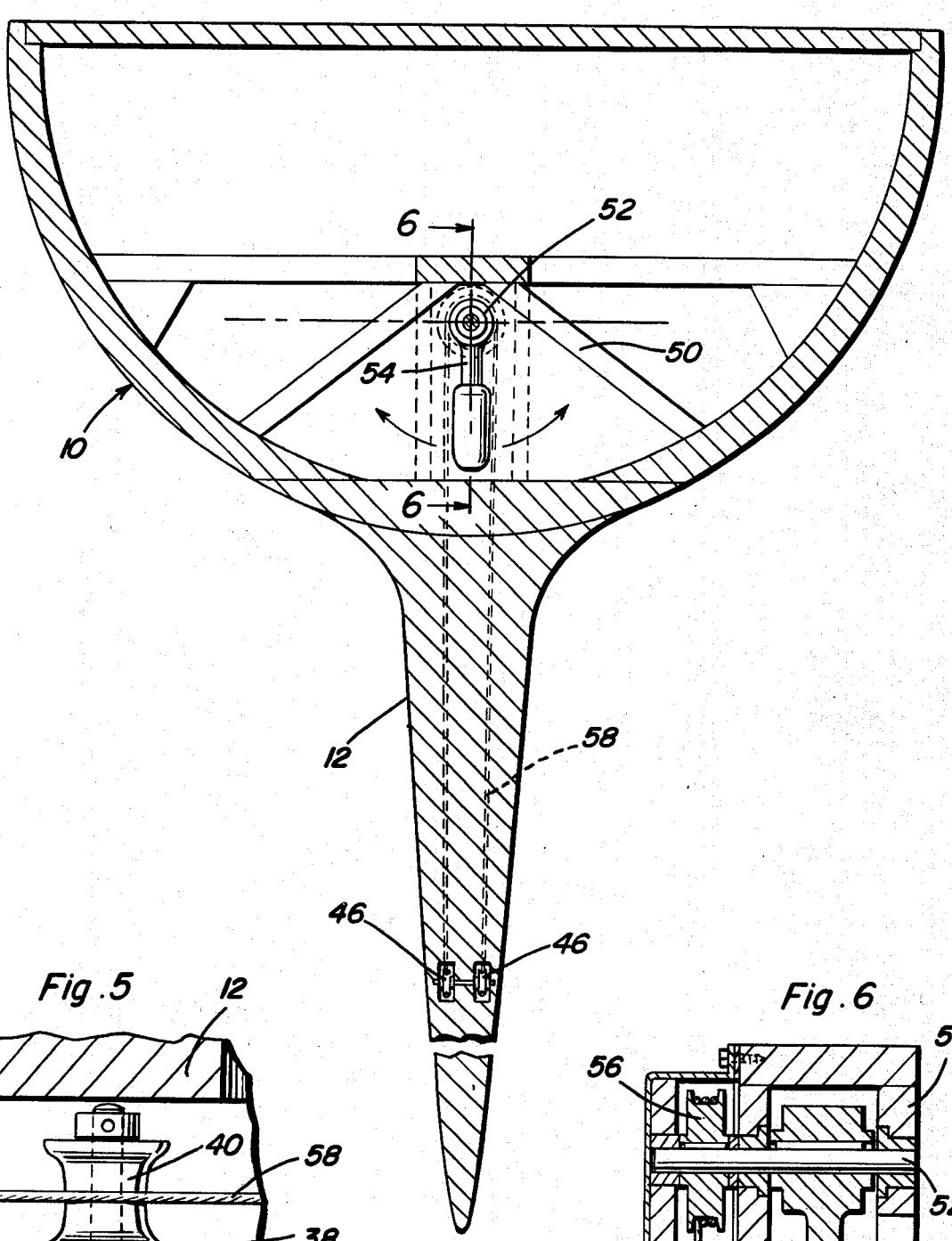
FIG. 4 is an enlarged vertical transverse sectional view taken substantially upon the plane indicated by the section line 4—4 of FIG. 1.
Figure 5:
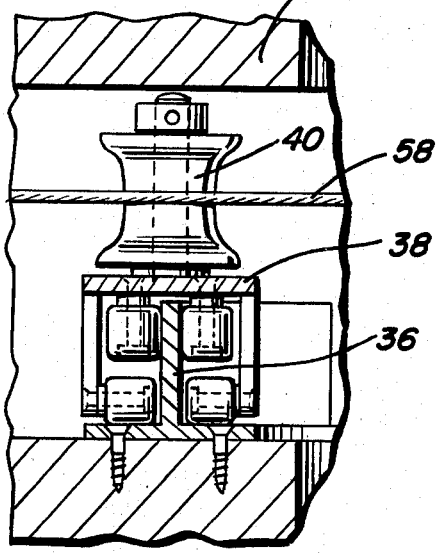
FIG. 5 is an enlarged fragmentary vertical sectional view illustrating a slidable pulley guide structure carried by the keel fin immediately forward of the forward end of the middle or main fin and with one of the control cables for displacing the rear servo fin operatively engaged therewith.
Figure 6:
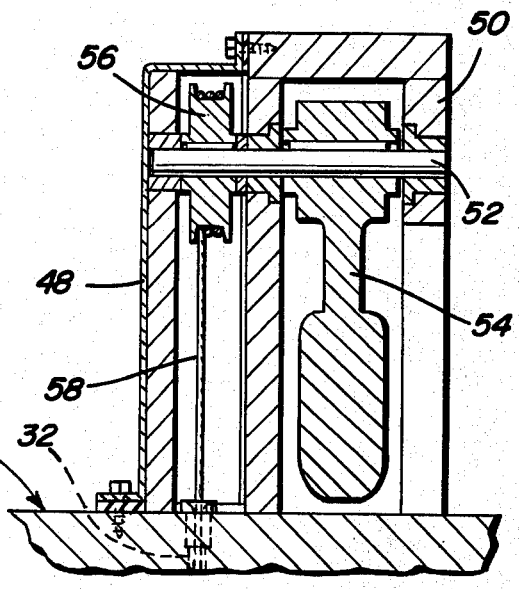
FIG. 6 is an enlarged longitudinal vertical sectional view taken substantially upon a plane indicated by the section line 6—6 of FIG. 4.

Referring now more specifically to FIG. 1, the numeral 10 generally designates a conventional form of sailboat hull including a single depending central keel fin 12 extending in a front-to-rear direction. The horizontal cross section of the keel fin 12 is that of a water foil and the rear upstanding trailing edge 14 of the keel fin 12 includes a horizontally rearwardly opening transverse recess 16 formed therein.

A main foil or fin 18 is disposed within the forward portion of the recess 16 and has its forward portion oscillatably supported from the keel foil 12 as at 20 and 22 for angular displacement of the main foil 18 about an upstanding axis. Further, a smaller upstanding servo foil 24 is oscillatably supported from the rear portion of the main foil or fin 18 as at 26 for angular displacement about an upstanding axis.

The main foil 18 has a central front-to-rear extending passage 28 formed therethrough and each end of the passage 28 has a pair of transversely spaced guide pulleys 30 journaled therein. Further, the keel foil has a vertical passage 32 formed therein opening upwardly into the interior of the hull 10 and downwardly into the forward end of a horizontally rearwardly opening passage 34 formed in the keel foil 12 and aligned with the forward end of the passage 28.

An arcuate track assembly 36 is mounted in a transversely widened rear portion of the passage 34 and supports a guide carriage 38 therefrom for limited movement transversely of the keel foil 10. The carriage 38 rotatably supports a pair of guide pulleys 40. Further, a central portion of the passage 34 includes opposite side pairs of large and small pulleys 42 and 44 and the forward end of the passage 34 includes a pair of opposite side pulleys 46 journaled for rotation about aligned horizontal transverse axes.

A closed downwardly opening housing 48 is mounted within the hull 10 and opens downwardly into the upper end of the passage 32. A mounting structure 50 is also mounted within the hull 10 from the housing 48 and is suitably braced relative to internal portions of the hull 10. A shaft 52 is journaled from the mounting structure 50 and the housing 48 and includes opposite end portions disposed in the mounting structure 50 and the housing 48. The end portion of the shaft 52 disposed within the mounting structure 50 has a bob weight 54 mounted thereon and the portion of the shaft 52 disposed within the housing 48 has a winding drum 56 mounted thereon. The middle portion of an elongated control cable 58 is wrapped several times about the winding drum 56 and the opposite end portions of the cable 58 extend downwardly through the housing 48 and the passage 32 and are passed beneath the pulleys 46. The control cable ends thereafter pass rearwardly through the passage 34, between the corresponding pairs of rollers 42 and 44, between the rollers 40 and on opposite sides of guide pins 60 and 62 carried by the carriage 38 and the forward extremity of the main fin 18 before passing between the pulleys 30 at the front and rear portions of the passage 28 and being anchored to opposite side portions of the forward end of the fin 24 as at 64.

Figure 7A:
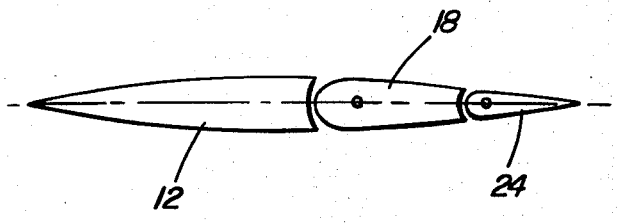
FIG. 7*a* is a schematic view illustrating the keel, main and servo fins in aligned positions.
Figure 7B:
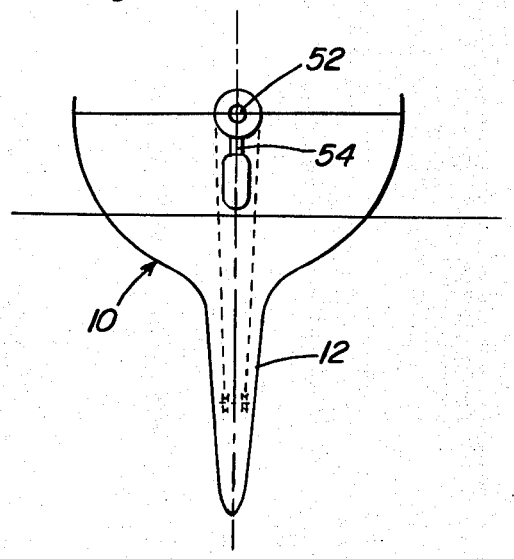
FIG. 7*b* illustrates the hull in an upright position as when the keel, main and servo fins are aligned per the illustrations thereof in FIG. 7*a;*
Figure 8A:
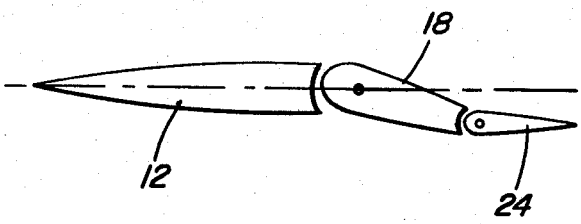
FIG. 8*a* is a further schematic view illustrating the servo fin displaced to starboard relative to the main fin and with the latter displaced to port.
Figure 8B:
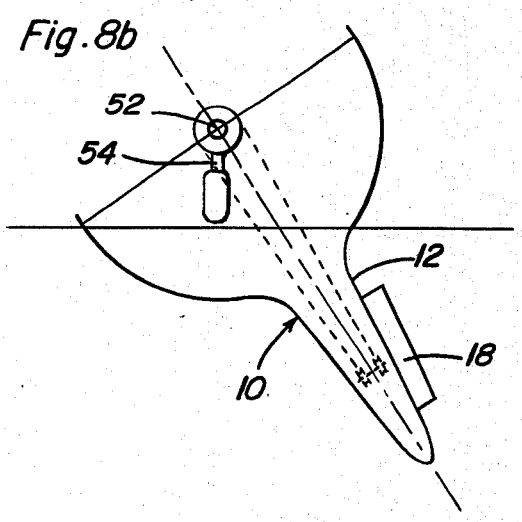
FIG. 8*b* is a schematic view of the hull heeled to starboard and with the main and servo fins displaced to the positions thereof illustrated in FIG. 8*a*.

When the hull 10 is disposed upright as illustrated in FIG. 7*b*, the winding drum of the vertical bob weight 54 is positioned in a manner to maintain the servo fin 24 aligned with the main fin 18 and accordingly the main fin 18 remains aligned with the keel fin 12. However, if the hull 10 heels to starboard as illustrated in FIG. 8*b*, the bob weight 54 swings to starboard and the winding drum 56 is thus positioned to cause the servo fin 24 to be displaced to starboard relative to the main fin 18. The side pressure of water on the servo fin 24 as a result of forward movement of the hull 10 through the water causes the main fin 18 to be displaced to port and the side pressure of water acting upon the main fin 18 effects a righting moment on the hull 10.

Figure 9A:
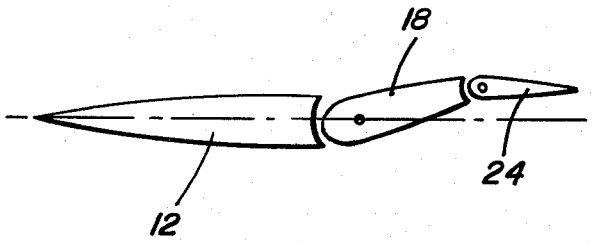
FIG. 9*a* is yet another schematic view similar to FIG. 8*a* but with the servo fin displaced to port relative to the main fin and the latter displaced to starboard.
Figure 9B:
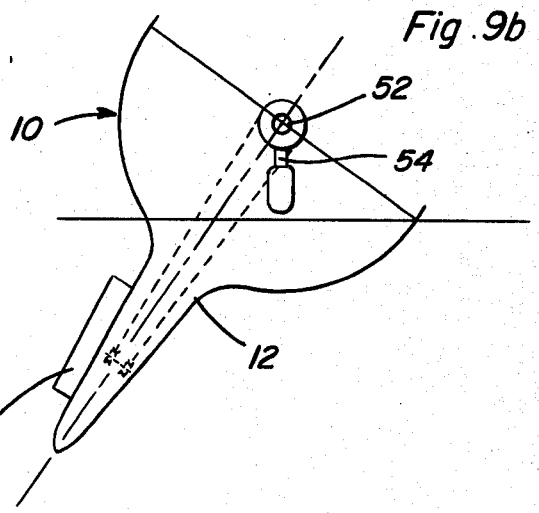
FIG. 9*b* is a schematic view of the hull heeled to port with the main and servo fins relatively positioned as shown in FIG. 9*a*.

On the other hand, if the hull 10 heels to port in the manner illustrated in FIG. 9*b*, the bob weight 54 is displaced to port and the servo fin 24 is displaced to port relative to the main fin 18 resulting in the latter being displaced to starboard to thereby exert a righting moment on the hull 10.

Although the instant invention has been specifically illustrated and described herein as applied to a sailboat hull including a depending keel fin, it is to be understood that the invention may also be applied to a motorboat hull. Further, although the keel fin 12 defines a stable support from which the main fin 18 may be oscillatably supported, it is not critical that the main fin 18 be supported from a keel fin. Rather, the main fin 18 could be supported from some other type of depending support structure.

It will also be noted that if the axis of oscillation of the main fin 18 is shifted rearwardly relative to the latter, less force exertion by the servo fin 24 will be required to achieve a given angular displacement of the main fin 18. Accordingly, the servo fin 24 may be appreciably decreased in size relative to the size of the main fin 18.

It is also pointed out that the only power needed to operate the righting moment producing fin structure of the instant invention comprises the pendulum action of the bob weight 54 and accordingly no external power source is needed. Further, other than the weight of the main and servo fins 18 and 24, the only further addition of weight to the hull 10 comprises the housing 48, the mounting structure 50, the shaft 52, the bob weight 54, the winding drum 56 and the control cable 58. Accordingly, the instant invention may be readily incorporated into existing hulls as well as hulls presently being manufactured with only a small addition of weight thereto.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a boat hull including at least one depending below water line front-to-rear extending main fin, said fin being oscillatably supported from said hull for angular displacement about an upstanding axis spaced forward of the horizontal longitudinal center of said fin, the rear portion of said fin including an upstanding servo fin oscillatably supported therefrom for angular displacement about an upstanding axis, and hull heeling sensing force means operatively connected between said hull and said servo fin for oscillating the latter relative to said main fin in response to opposite heeling movement of said hull, said hull including a pendulum weight mounted therein for oscillation about a horizontal axis extending longitudinally of said hull and comprising a part of said hull heeling sensing force means, said force means also including motion transmitting means operatively connected between said pendulum and said servo fin for oscillating the latter in response to oscillation of the former, said motion transmitting means including a winding drum oscillatable with said pendulum and a pair elongated flexible tension member sections connected to said drum for opposite winding thereon and trained through the interior of said main fin and anchored to laterally opposite portions of said servo fin at points thereon spaced forward of its axis of oscillation.

2. The combination of claim 1 wherein said hull includes a depending keel fin, said main fin being oscillatably supported from a rear portion of said keel fin.

3. The combination of claim 2 wherein said keel fin includes an upstanding rear edge portion having a horizontally rearwardly opening transverse recess formed therein, said main fin being mounted in said recess.

4. The combination of claim 3 wherein said servo fin is at least substantially fully received in said recess when said main and servo fins are aligned with said keel fin.

5. The combination of claim 1 wherein said hull comprises the hull of a sailboat.

6. The combination of claim 2 wherein said depending keel fin comprises a single central longitudinal fin.

7. The combination of claim 1 wherein the horizontal transverse outline area of said main fin is considerably greater than the horizontal transverse outline area of said servo fin.

* * * * *